United States Patent [19]

Lyman, Jr.

[11] 3,946,975

[45] Mar. 30, 1976

[54] CLIMBER'S CHOCKSTONE

[76] Inventor: Thomas G. Lyman, Jr., The White Mountain School, Seven Springs, Littleton, N.H. 03561

[22] Filed: Apr. 9, 1975

[21] Appl. No.: 566,207

[52] U.S. Cl. ..... 248/1; 248/317

[51] Int. Cl.[2] ..... A47G 29/00

[58] Field of Search ..... 248/1, 216, 317; 24/115, 24/265 EC, 136 K, 135, 196, 171; 9/46; 294/74, 78; D8/230; 403/409, 211, 374

[56] References Cited

OTHER PUBLICATIONS

EMS 72–73.

Summit, Mar., 1969, Bill Dolt.

Advanced Rockcraft, Royal Robbins, pp. 18–19, 1973.

*Primary Examiner*—Roy D. Frazier

*Assistant Examiner*—Robert A. Hafer

*Attorney, Agent, or Firm*—Bacon & Thomas

[57] ABSTRACT

A climber's chockstone is formed of a polycarbonate resin to define a body having three pairs of opposed faces defining three wedges of different widths. The body has an opening or cavity extending through opposed faces and a loop of sling rope extends into the cavity and around a metal tube extending across the cavity.

6 Claims, 8 Drawing Figures

CLIMBER'S CHOCKSTONE

BACKGROUND OF THE INVENTION

Providing means for supporting climbers when climbing steep rock or mountains has been a problem. Traditionally, pitons have been used by rock climbers and mountaineers to provide anchor points when climbing steep rock faces or peaks. Various sized wedges are used, made of metal and equipped with an eye, They are driven into cracks in the rock with a small hammer and provide solid anchor points when they are placed properly and driven in firmly. The eye of the piton is outermost and a climbing rope is attached with a metal carabiner, a snap ring or metal loop with a spring-loaded gate. The problem with pitons is that they are often difficult to remove and reuse and their placement and removal seriously scars and damages the rock, especially in popular climbing areas where pitons are being rapidly replaced by metal nuts of various types.

SUMMARY OF THE INVENTION

The present invention is a lightweight device adapted to be wedged in existing cracks in rock and which may be readily removed.

It is, therefore, an object of this invention to provide a climber's chockstone adapting it for use in cracks of many different widths.

It is a further object of the invention to provide a climber's chockstone adapted to have a sling rope associated therewith and wherein the sling rope is protected from abrasion against the rock surface.

It is another object of this invention to provide a climber's chockstone that can be removed from a crack easily through use of the sling rope itself.

A still further object of this invention is to provide a climber's chockstone configured to produce a cam-like effect to jam the device securely in any crack of appropriate width regardless of the nature of the rock or its texture.

DESCRIPTION OF A PREFERRED EMBODIMENT

Figure 1:
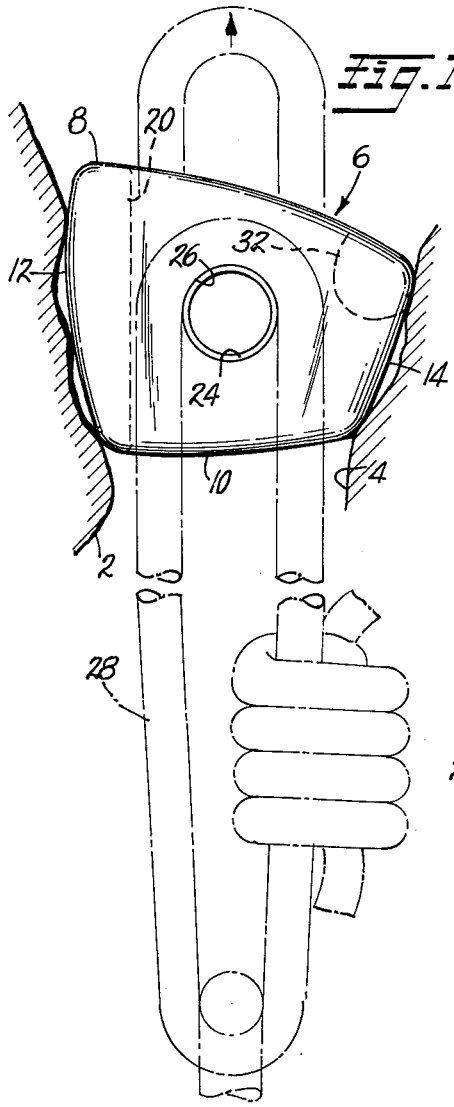
FIG. 1 is a side view of a chockstone of the present invention showing the same in place in a relatively wide crack.

In the drawings, 2 and 4 indicate opposite sides of a crack in a stone face or rock to be climbed and to which a climber desires to secure his climbing rope. The chockstone of the present invention, generally designated 6, comprises a unitary body of material formed to the configuration shown and having a first pair of opposed faces 8 and 10, a second pair of opposed faces 12 and 14 and a third pair of opposed faces 16 and 18. As shown, the opposed faces are external surfaces of the chockstone and the faces of each pair are outwardly convex and tapered generally from one side to the other so that the body in its entirety actually defines three different width wedges. Preferably, the chockstone 6 will be molded of a polycarbonate resin of the type identified as General Electric's "Lexan, type 101." This material provides a chockstone of light weight, thus imposing no great burden on a climber who carries several of them and which material is also extremely strong, resistant to abrasion and unlikely to shatter. However, other suitable materials may be used.

As also shown in the drawings, the body 6 is provided with an opening 20 therethrough which opening extends through the faces 8 and 10, for example, but inwardly of the other pairs of faces. It is also preferred that the opening 20 extend laterally, as at 22, to define a lateral extension of the opening through the face 14, for example. Extending transversely across the opening 20 is a support member 24 shown as a metal tube, preferably stainless steel, press fitted into a transverse bore 26 in the body 6. A loop of sling rope 28 is formed to extend into the opening 20 in embracing relation to the tubular support 24, as shown in FIG. 1. The sling rope 28 may be provided with any known or desired form of carabiner or the like 30 to which a climber's tie rope may be readily attached, all in a well known manner.

Figure 2:
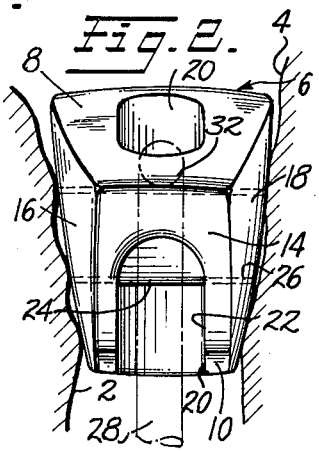
FIG. 2 is an end view of the device of FIG. 1 showing the same in place in a narrow crack.
Figure 3:
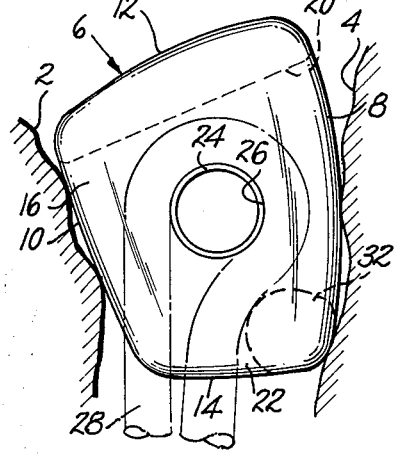
FIG. 3 is another side view of the device of FIG. 1 illustrating the manner of its use in a narrower crack than that of FIG. 1.
Figure 7:
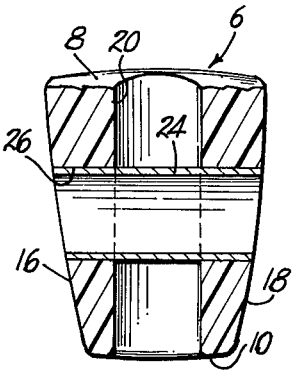
FIG. 7 is a sectional view taken along the line 7—7 of FIG. 4.
Figure 8:
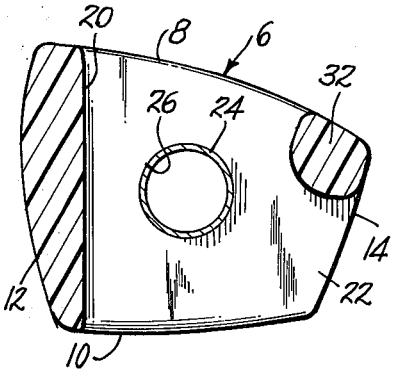
FIG. 8 is a sectional view taken along the line 8—8 of FIG. 4.
Figure 4:
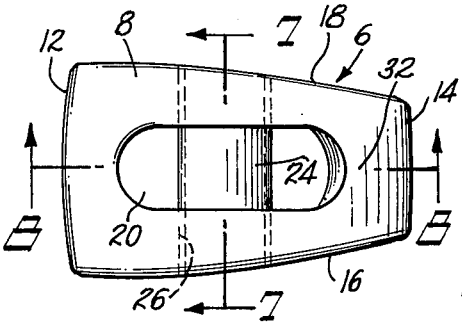
FIG. 4 is a top plan view of the chockstone as would be seen from the top of FIG. 1.
Figure 5:
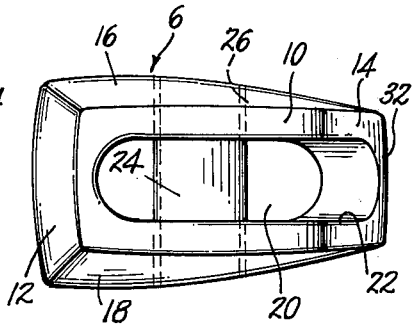
FIG. 5 is a bottom view of the chockstone as would be seen from the bottom of FIG. 1.
Figure 6:
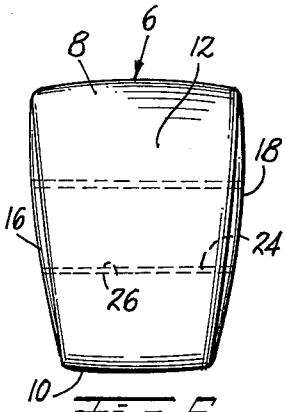
FIG. 6 is an end view of the chockstone as would be seen from the left side of FIG. 1.

In use, when a climber reaches a point where he desires to provide an anchor point in an available crack in the rock, the chockstone may be placed in the crack in any one of the positions shown in FIGS. 1, 2 or 3, depending upon the width of the crack and the size of the particular chockstone employed whereupon a slight downward pull on the sling rope 28 will firmly wedge the chockstone in the crack and provide a firm anchor point for the climber. As shown in FIGS. 1 and 2, the sling rope 28 depends through that portion of opening 20 extending through face 10 but in the position shown in FIG. 3, the sling rope 28 extends outwardly of the body 6 through the enlargement of opening 20 previously identified as portion 22 thereof. The integral strut portion 32 of the chockstone bears against a side of the rope sling 28 but does not interfere with its free suspension downwardly from the chockstone to support a climber.

As stated previously, it is desirable that anchor devices used by climbers be easily removed as the climber progresses upwardly and it is advantageous that they be readily and easily removable from the rock crack without unduly disfiguring or marring the rock surface and without requiring the climber to carry heavy or burdensome equipment to effect such removal. The chockstone of the present invention lends itself readily to very easy and rapid removal. When it is desired to remove the chockstone 6 from the crack, as shown in FIG. 1, for example, the sling rope 28 is pushed upwardly so that its upper end projects upwardly through the face 8, as shown in broken lines in FIG. 1. Thereupon, the climber may grasp the upwardly projecting portion of the sling rope and by pulling or jerking upwardly thereon, the wedged chockstone will be dislodged from the walls 2 and 4 and freed of the crack without further manipulation and may thereupon be wedged in another or the same crack at a higher elevation using whichever pair of opposed faces may be appropriate for the width crack at the next desired anchor point.

From the foregoing description it is apparent that applicant has provided a lightweight chockstone easily and readily manipulated to provide a firm anchor point or to be released therefrom and with which abrasion of the climber's rope is at a minimum. It is to be noted that the climber's rope sling need not engage the rock surface at all and thus the danger of abrasion from the rock is minimized. Clearly, a chockstone embodying the principles of the present invention may be constructed in any desired size or range of sizes without departing from the spirit of this invention.

While a single specific embodiment has been shown and described herein, the same is merely illustrative of the principles involved and other forms and configurations may be resorted to within the scope of the appended claims.

I claim:

1. A climber's chockstone comprising:

a generally cubical body having six faces defining three pairs of opposed external faces, the faces of each pair being spaced apart a distance different from the distance between the faces of the other pairs with the faces of each pair converging in one direction whereby said body defines three wedges of different widths;

a cavity in said body and having a continuous opening extending through at least one face of one pair and through a major portion of an adjacent face between the faces of the other pair;

a support member extending across said cavity within said body generally normal to said other pair of faces; and a loop of sling rope extending around said support member and outwardly of said body through said opening.

2. A chockstone as defined in claim 1 wherein said faces are outwardly convex.

3. A chockstone as defined in claim 1 wherein said body is of polycarbonate resin and said support member is of metal rigidly fixed in said body.

4. A chockstone as defined in claim 1 wherein said cavity extends completely through said body whereby said loop may extend from said support member through either said one face or the face opposed thereto.

5. A chockstone as defined in claim 1 wherein said one face is adjacent the narrowest end of the wedges defined by the other pairs of faces.

6. A chockstone as defined in claim 3 wherein said support member is a metal tube extending through said body and across said cavity.

* * * * *